US011236546B2

(12) United States Patent
Zhang

(10) Patent No.: US 11,236,546 B2
(45) Date of Patent: Feb. 1, 2022

(54) PULL CORD ARRANGEMENT

(71) Applicant: IKEA SUPPLY AG, Pratteln (CH)

(72) Inventor: Bo Zhang, Lund (SE)

(73) Assignee: IKEA Supply AG, Pratteln (CH)

( * ) Notice: Subject to any disclaimer, the term of this patent is extended or adjusted under 35 U.S.C. 154(b) by 274 days.

(21) Appl. No.: 16/313,562

(22) PCT Filed: Jun. 28, 2017

(86) PCT No.: PCT/SE2017/050715
§ 371 (c)(1),
(2) Date: Dec. 27, 2018

(87) PCT Pub. No.: WO2018/004437
PCT Pub. Date: Jan. 4, 2018

(65) Prior Publication Data

US 2019/0169929 A1 Jun. 6, 2019

(30) Foreign Application Priority Data

Jul. 1, 2016 (SE) ..... 1650957-2

(51) Int. Cl.
*E06B 9/78* (2006.01)
*E06B 9/326* (2006.01)
(Continued)

(52) U.S. Cl.
CPC ..... *E06B 9/78* (2013.01); *E06B 9/326* (2013.01); *E06B 9/42* (2013.01); *E06B 9/60* (2013.01); *E06B 2009/785* (2013.01)

(58) Field of Classification Search
CPC . E06B 9/78; E06B 9/324; E06B 9/326; E06B 2009/785; E06B 2009/3265
See application file for complete search history.

(56) References Cited

U.S. PATENT DOCUMENTS 5,465,775 A * 11/1995 Biba ..... E06B 9/306 160/168.1 R
5,513,687 A 5/1996 Tuzmen et al.
(Continued)

FOREIGN PATENT DOCUMENTS

CA 2357956 A1 3/2003
DE 202009013368 U1 4/2010
(Continued)

OTHER PUBLICATIONS

Supplementary European Search Report for EP Application No. 17 82 065 dated Jan. 20, 2020 (5 pages).
(Continued)

*Primary Examiner* — Colleen M Chavchavadze
*Assistant Examiner* — Matthew R. Shepherd
(74) *Attorney, Agent, or Firm* — Merchant & Gould P.C.

(57) ABSTRACT

The invention refers to a pull cord arrangement for a roller blind or a venetian blind, comprising a winding element (4) arranged to be connected to a blind (6) such that the blind (6) is released or wound in response to a rotational movement of the winding element (4) about a rotational axis; a connecting element (28) coupled to the winding element (4) to rotate together with the winding element (4); and a pull cord (50) engaging the connecting element (28) so as to control the rotation of the connecting element (28) and thus the winding element (4) as the pull cord (50) is operated.

9 Claims, 6 Drawing Sheets

(51) Int. Cl.
*E06B 9/42* (2006.01)
*E06B 9/60* (2006.01)

(56) References Cited

U.S. PATENT DOCUMENTS 5,709,258 A * 1/1998 Coccoluto ..... E06B 9/326 16/442
6,516,860 B1 * 2/2003 Weaver ..... E06B 9/30 160/168.1 R
8,286,686 B2 * 10/2012 Cannaverde ..... E06B 9/326 160/320
8,739,852 B2 6/2014 Anderson
8,763,675 B2 * 7/2014 Zhu ..... E06B 9/324 160/321
2003/0192654 A1 * 10/2003 Nien ..... E06B 9/322 160/168.1 R
2012/0090795 A1 * 4/2012 Kirby ..... E06B 9/40 160/307
2012/0160431 A1 * 6/2012 Cannaverde ..... E06B 9/326 160/340
2013/0306253 A1 * 11/2013 Ho ..... E06B 9/326 160/168.1 R

FOREIGN PATENT DOCUMENTS

WO WO 2008/063566 A2 5/2008
WO WO 2015/172754 A1 11/2015
WO WO-2015172754 A1 * 11/2015 ..... E06B 9/324

OTHER PUBLICATIONS

International Search Report and Written Opinion for PCT/SE2017/050715 dated Sep. 11, 2017.

* cited by examiner

PULL CORD ARRANGEMENT

This application is a National Stage Application of PCT/SE2017/050715, filed 28 Jun. 2017, which claims the benefit of priority to Swedish Patent Application No. 1650957-6, filed 1 Jul. 2016, which applications are incorporated herein by reference. To the extent appropriate, a claim of priority is made to each of the above disclosed applications.

TECHNICAL FIELD

The present invention concerns a pull cord arrangement for a roller blind or a venetian blind.

TECHNICAL BACKGROUND

It is well known in the art to use a pull cord mechanism to drive a window shade or a venetian blind. The pull cord mechanism typically comprises an endless cord which operatively communicates with the window shade or the venetian blind to release or wind the same. In the case of a window shade a pulling of the endless cord is converted into a rotation of the tube holding the window shade. In case of a venetian blind, a pulling of the endless cord results in a folding or unfolding of the pleated blind. The pull cord may be a cord or a bead cord.

In its simplest form, the endless cord is freely exposed. For a playful child this poses a problem, either by strangling or choking. It is also a risk that the whole arrangement also is torn down.

WO 2015/172754 presents one solution to the problem in which the endless cord is enclosed in a hollow rod provided with a slit. The endless cord is pulled by a slider which is arranged slidingly on the hollow rod while engaging the endless cord. The slider comprises a biased control button which when subjected to a pressure engages the endless cord and in this state the slider can be slid along the hollow rod to either release or wind the blind. If the window is large, or for a person who cannot reach the full window height, the control button can be released and the slider can be moved without contact with the cord, and by pressing the control button once more allow the full height of the blind to be controlled. However, it may be difficult for a user to understand how to operate the control button. In addition, the length of the rod may have to be adapted to the height of the window opening. Thus, for large windows, the rod will be bulky. Also, it may be considered not to be very user-friendly, neither for disabled persons nor for first time users.

Yet another pull cord arrangement is known from US2012/0090795 A1. The arrangement uses a pull cord and two elongated telescoping structures where the telescoping structures are connected to the respective free ends of a pull cord.

SUMMARY

One object of the present invention is to provide a mechanism that is childproof. Another object is to provide a mechanism that is intuitive when it comes to the understanding of how to operate the same. Further, the mechanism should be easy to use for disabled people.

These and other objects are solved by a pull cord arrangement for a roller blind or a venetian blind, comprising a winding element arranged to be connected to a blind such that the blind is released or wound in response to a rotational movement of the winding element about a rotational axis, a connecting element coupled to the winding element to rotate together with the winding element, and a pull cord engaging the connecting element so as to control the rotation of the connecting element and thus the winding element as the pull cord is operated. The ratio between the engagement diameter d of the connecting element at which diameter the pull cord operatively engages the connecting element and the outer diameter D of the winding element is smaller than 2:3. The arrangement is characterized in that the pull cord arrangement further comprises a pull cord actuator formed by a telescopic rod comprising a first rod and a second rod, the second rod being movable in relation to the first rod along a longitudinal extension of the first rod, and wherein the pull cord is connected to the second rod, whereby the pull cord is operated by moving the second rod along the longitudinal extension of the first rod. The pull cord comprises in a position along its longitudinal extension a carrier; wherein the first rod along its longitudinal extension comprises a slit in which the carrier of the pull cord is movably received. The second rod further comprises in a surface facing the slit a locking element engaging the carrier, whereby the pull cord is operated as the second rod is moved along the first rod.

The term engagement diameter d is defined as the diametrical distance as measured transverse the longitudinal centre axis L of the winding element between the leading part and the trailing part of a looped shaped pull cord which operatively engages the connecting element. Accordingly, in case of the pull cord being a bead chain, the engagement diameter d is measured between the cord of the leading part of the pull cord and the cord of the trailing part of the pull cord.

By the ratio, a gear change is provided that requires a reduced length of the stroke required to release or wind the blind. Accordingly, the length of the pull cord may be reduced. This allows the pull cord to be less eye-catching when hanging down along the window. The pull cord will also be less attempting as a potential plaything for children and pets and it is less likely that it will interfere with flowerpots and other decorations in and around the windowsill.

To release the blind, the telescopic rod is pulled and to be wound the telescopic rod is pushed. By the ratio between the diameters of the connecting element and the winding element, the length of the first and second rod making up the telescopic rod may be reduced. Thereby the telescopic rod will be less eye-catching. Also, the required stroke to release or wind the blind is reduced to the same extent.

The pull cord may form a closed loop and be a bead chain, a toothed belt, a perforated belt or a chain, and the connecting element may along its outer circumference as seen transverse the rotational axis comprise projections engaging the pull cord.

The pull cord may be received inside the first rod. Thereby the pull cord is protected from being a plaything for children and pets. Also, there is no risk of the pull cord interfering with curtains, or with flowerpots and decorations often standing on the windowsill.

The first rod may be pivotably arranged about the rotational axis of the winding element. Thereby the pull cord actuator may be freely hanging in a vertical position when not in use and when to be operated the operator may pivot the same away from the window frame and push/pull the telescopic rod to/from his body.

It is to be understood that the first rod with remained function may be arranged on the winding element or a connector interconnecting the connecting element and the winding element, and wherein the first rod is pivotably arranged about the rotational axis of the winding element.

The first rod may encase the connecting element. Thereby the centre line of the first rod may coincide with the extension of the pull cord. Thus no undue bending forces will be applied to the connecting element when operating the pull cord arrangement. Also, the engagement between the connecting element and the pull cord is protected from interfering with foreign items.

The winding element may be a tube, the outer envelope surface thereof forming a support onto which the blind of a roller blind is to be wound or a support onto which the strings of the venetian blind are to be wound. The tube may be supported by a central shaft forming the winding element or be directly connected to the connecting element.

The winding element may comprise a spring providing a rotational biasing of the winding element. A biasing may be advantageous for blinds having a length exceeding 1200 mm to thereby relieve the pull cord arrangement.

The ratio between the engagement diameter d of the connecting element at which diameter the pull cord operatively engages the connecting element and the outer diameter D of the winding element may be smaller than 1:2, more preferred smaller 1:3 and even more preferred smaller than 1:4.

Further objects and advantages of the present invention will be obvious to a person skilled in the art reading the detailed description given below describing different embodiments.

BRIEF DESCRIPTION OF THE DRAWINGS

The invention will be described in detail with reference to the schematic drawings.

DETAILED DESCRIPTION

Figure 1:
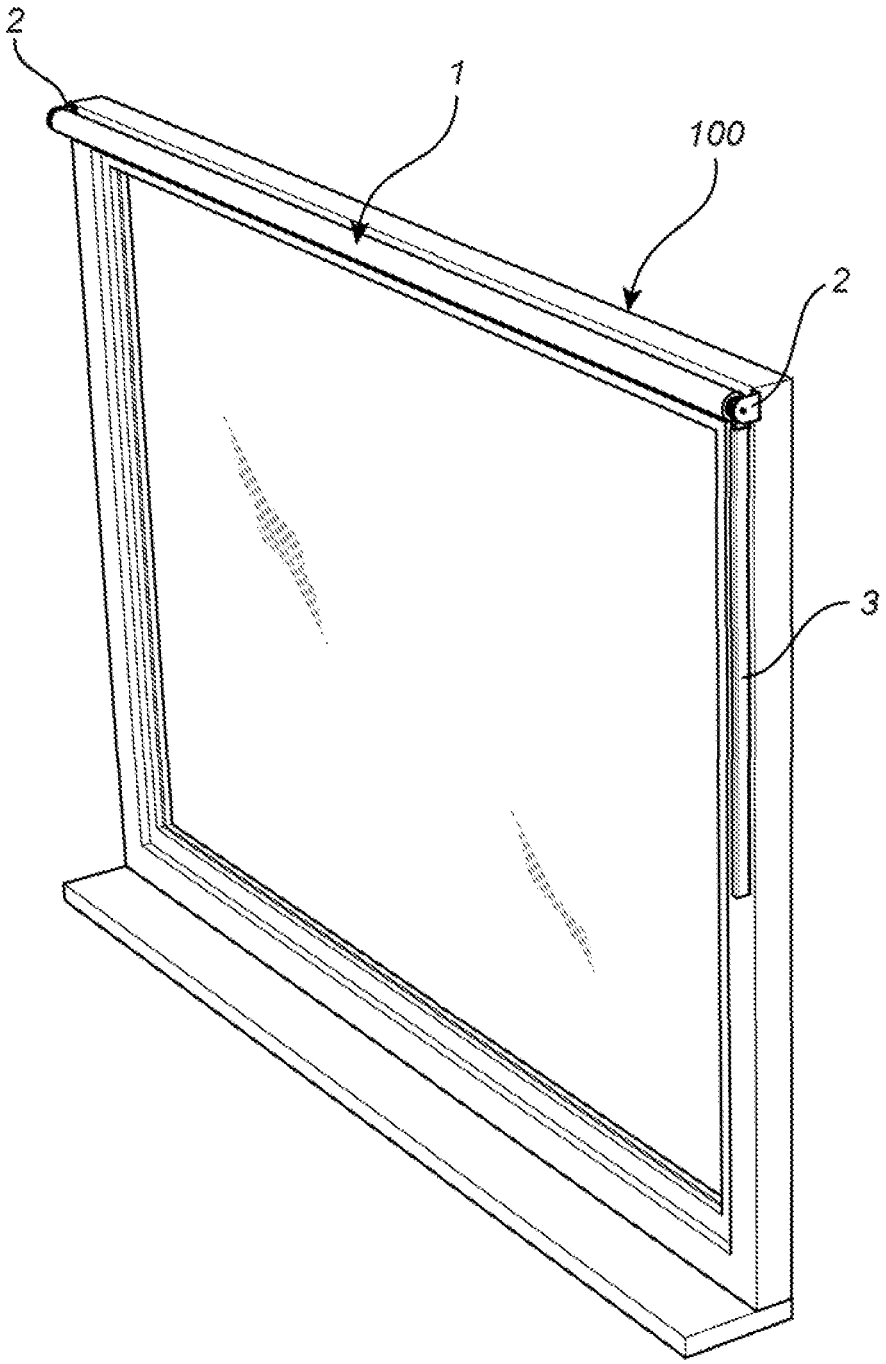
FIG. 1 discloses a window with a roller blind.

Now turning to FIG. 1 a window with a roller blind 1 is schematically disclosed. The roller blind 1 is mounted at its two opposing free edges along the upper border of the window frame 100 by means of holders 2. The roller blind 1 is operated by a pull cord actuator 3. The invention will throughout the description and the illustrations refer to a roller blind. The very same principle is equally applicable to a venetian blind. The essential difference is that instead of winding a blind onto the winding element, the cords of the venetian blind are wound onto the winding element.

Figure 2:
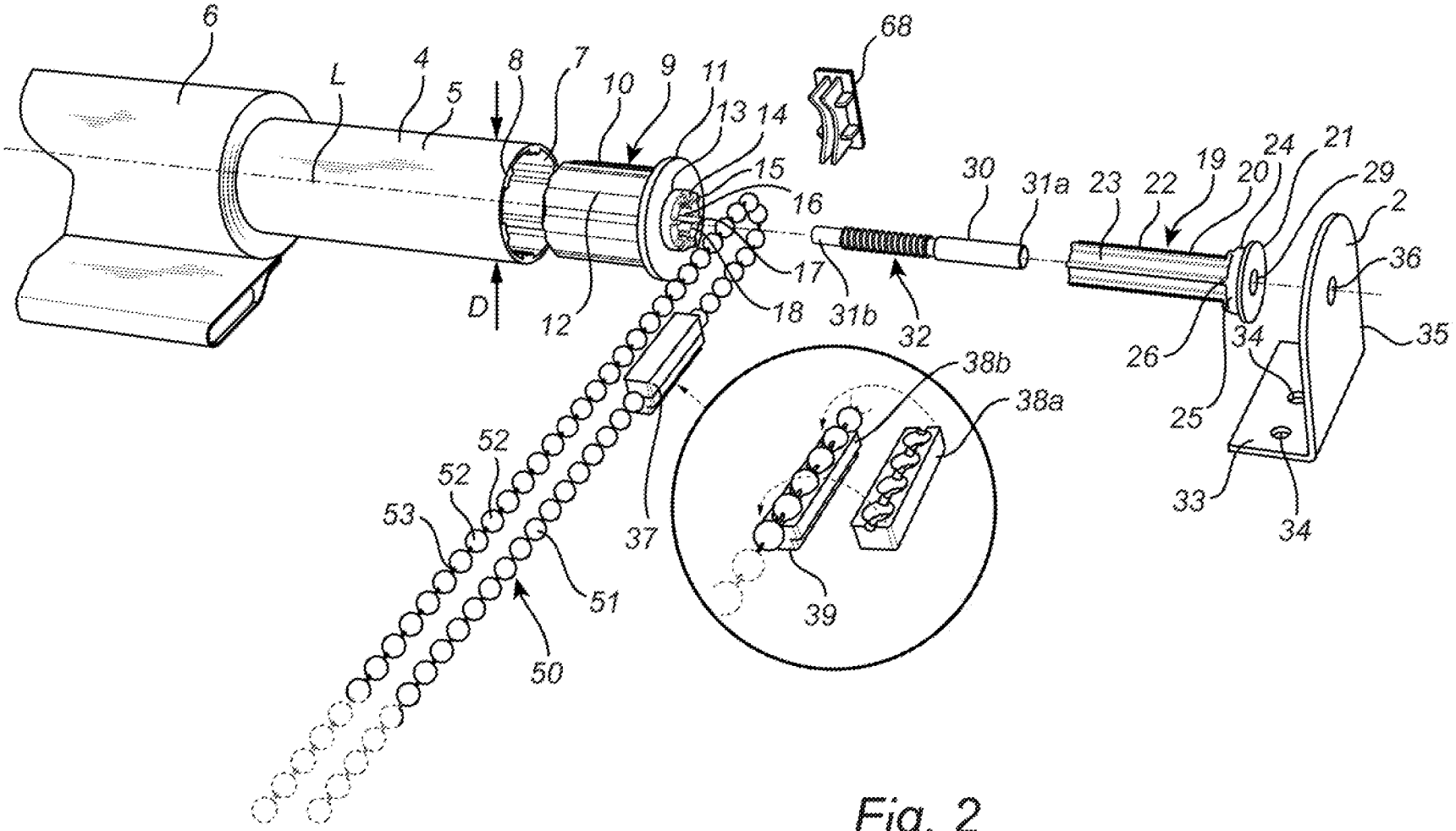
FIG. 2 discloses an exploded view of a pull cord arrangement according to the present invention.

Now turning to FIG. 2 an exploded view of the pull cord arrangement is disclosed. Starting from the left, the arrangement discloses a winding element 4 which in the disclosed embodiment is formed by a tube 5 having a circular cross section. The winding element has an outer diameter D.

A blind 6 is wound onto the outer circumference of the winding element 4. The blind 6 may be any type of material suitable for winding, such as textile, plastic, metal film or paper.

The inner wall 7 of the tube 5 is provided with at least one projection 8. In the disclosed embodiment a plurality of projections are used, each having an extension in parallel with the longitudinal center axis L of the winding element 4 and hence the rotational axis.

The winding element 4 may be provided by extrusion and cut to desired length depending on the width of the window frame 100.

A first connector 9 is connected to the free end of the winding element 4. The first connector 9 has a tube shaped portion 10 and a flange portion 11. The tube shaped portion 10 is provided along its outer circumferential wall with at least one groove 12 adapted to engage the at least one projection 8 of the winding element 4. Thereby the first connector 9 will connect to and rotate together with the winding element 4.

The flange portion 11 is on its surface facing away from the winding element 4 provided with a first neck portion 13. The first neck portion 13 has an extension along the longitudinal centre axis L of the winding element 4. The first neck portion 13 is along its end surface 14 extending transverse the longitudinal center axis L provided with a plurality of radial projections 15. The radial projections 15 are adapted to engage a pull cord 50 to be discussed below. The radial projections 15 serve as teeth engaging the interspace between subsequent links of the pull cord 50. In case the pull cord 50 being a ball chain 51 with a plurality of balls 52 interconnected by a cord 53, one ball 52 is received between two adjacent radial projections 15.

The first connector 9 further comprises a channel 16 coinciding with the longitudinal centre axis L. The inner circumferential wall 17 of the channel 16 is provided with at least one projection 18 having an extension in parallel with the longitudinal centre axis L.

The first connector 9 may by formed as a unitary body by e.g. injection molding a plastic material.

The pull cord arrangement further comprises a second connector 19. The second connector 19 has a longitudinal extension comprising a tube shaped portion 20 and a flange portion 21. The tube shaped portion 20 is along its outer circumferential wall 22 provided with at least one groove 23 adapted to engage the at least one projection 18 of the channel 16 of the first connector 9. Thereby the first connector 9 will connect to and rotate together with the second connector 19 and hence together with the winding element 4.

The second connector 19 may be formed as a unitary body by e.g. injection molding a plastic material.

The flange portion 21 of the second connector 19 has a radial extension. The flange portion 21 is on its surface facing the winding element 4 provided with a second neck portion 24. The second neck portion 24 has an extension along the longitudinal centre axis L of the winding element 4. The second neck portion 24 is along its end surface 25 provided with a plurality of radial projections 26 adapted to engage the pull cord 50.

The number of radial projections 15 of the first connector 9 and their circumferential distribution equals the number of radial projections 26 of the second connector 19 and their circumferential distribution. Further, the position of the at least one projection 18 of the first connector 9 mating the at least one groove 23 of the second connector 19 ensures that when the tube shaped portion 20 of the second connector 19 is inserted into the channel 16 of the first connector 9, the radial projections 15, 26 of the first and the second connectors 9, 19 will be longitudinally aligned to thereby form radial pockets 27. This is best seen in FIG. 4*a*.

Thus, in the disclosed embodiment a connecting element 28 is defined by the first and second neck portions 13, 24 of the first and second connectors 9, 19 abutting each other. The connecting element 28 can be seen as a sprocket with a number of teeth formed by the radial projections 15, 26 and intermediate pockets 27. Each pocket 27 is adapted to engage an individual link of a pull cord 50. In case of the pull cord 50 being a ball chain, each ball 52 constitutes a link.

Figure 4A:
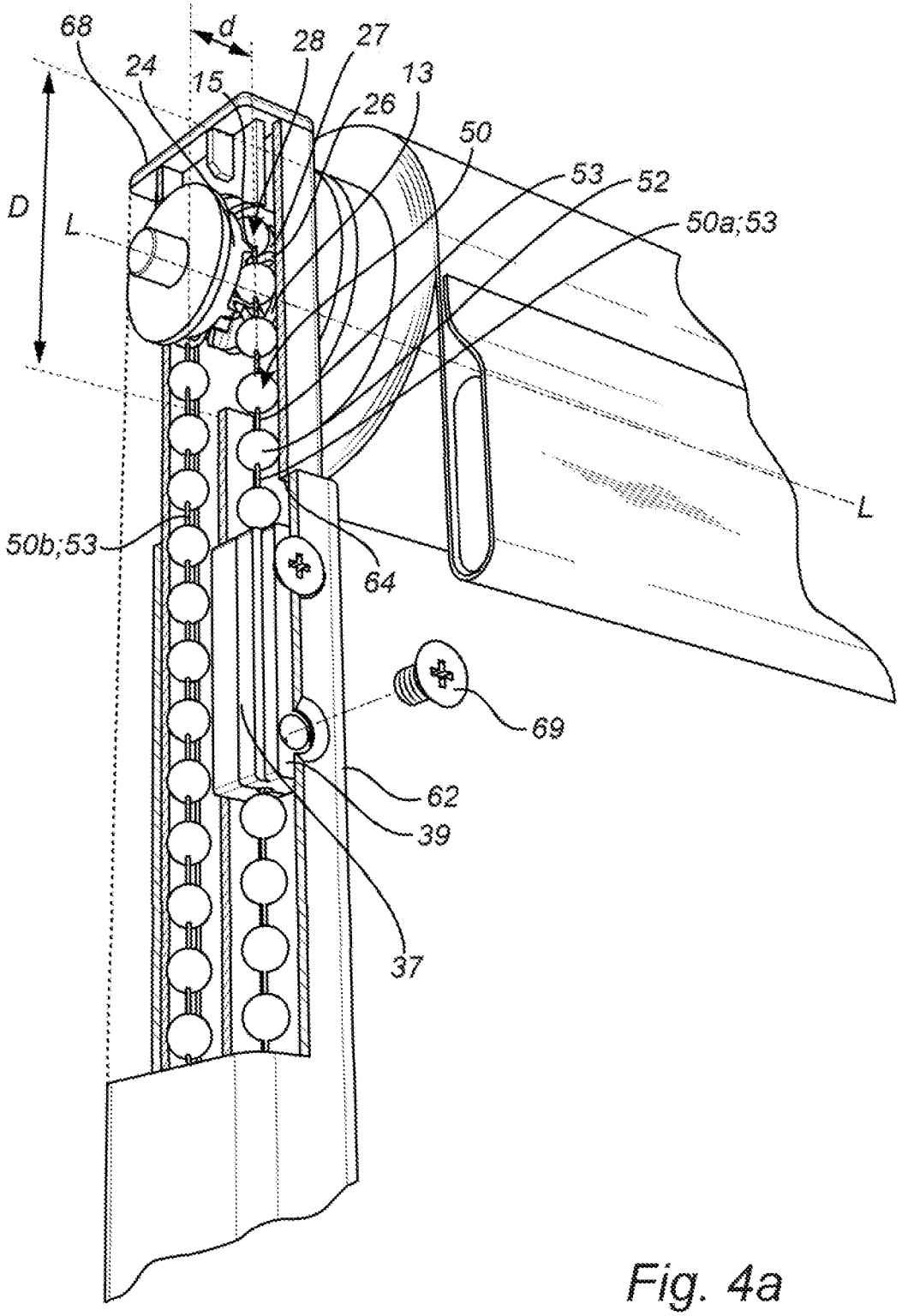
FIG. 4*a* discloses the pull cord arrangement set to its fully wound position. To facilitate the understanding the pull cord actuator has been partly removed.

As can be seen in FIG. 4*a*, the radial projections 15, 26 may be slanted in the radial direction to accommodate the cord 53 interconnecting the individual balls 52 of the ball chain.

The connecting element 28 exhibits an engagement diameter d. The engagement diameter d is defined as the diametrical distance as measured transverse the longitudinal centre axis L of the winding element 4 between the leading part 50*a* and the trailing part 50*b* of the looped shaped pull cord 50 when the pull cord 50 operatively engages the connecting element 28. Accordingly, in case of the pull cord 50 being a bead chain, the engagement diameter d is measured between the cord 53 of the leading part 50*a* of the pull cord 50 and the cord 53 of the trailing part 50*b* of the pull cord 50.

The ratio between the engagement diameter d of the connecting element 28 and the outer diameter D of the winding element 4 should be smaller than 1:2 and more preferred smaller than 1:3 and even more preferred smaller than 1:4.

Now turning to FIG. 2 anew, the second connector 19 has a through channel 29 coinciding with the longitudinal center axis L of the winding element 4. The through channel 29 is adapted to receive and engage a shaft 30 extending there through. When inserted into the through channel 29, a first end 31*a* of the shaft 30 extends past the second connector 19 away from the winding element 4. The second end 31*b* of the shaft 30 extends into the first connector 9 and rests against a non disclosed anvil. Further, the shaft 30 supports a biasing spring 32 which provides a rotational biasing of the winding element 4. The first end 31*a* end of the shaft 30 is adapted to engage a holder 2.

The holder 2 is adapted to be mounted to the window frame 100 to thereby support the roller blind 1. In it easiest form, the holder 2 is provided as a L-shaped member. The first flange 33 of the L-shaped holder is provided with holes 34 for mounting the holder 2 to the window frame 100. The second flange 35 is provided with a through hole 36 adapted to rotatably receive the first end 31*a* of the shaft 30. To allow the rotation, the through hole 36 has a diameter that slightly exceeds the diameter of the first end 31*a* of the shaft 30.

As given above the pull cord 50 is arranged to engage the connecting element 28 that is defined between the first and second connectors 9, 19. The pull cord 50 is provided along its longitudinal extension with a carrier 37. The carrier 37 may be arranged as a chain lock keeping the free ends of the pull cord 50 together.

In the disclosed embodiment the carrier 37 is formed as two parts 38*a*, 38*b* arranged one on top of the other to thereby enclose the pull cord 50. The two parts 38*a*, 38*b* may engage each other by means of e.g. adhesive, a screw or a snap-lock. The carrier 37 comprises in a surface facing away from the pull cord 50 a projection 39.

Figure 3:
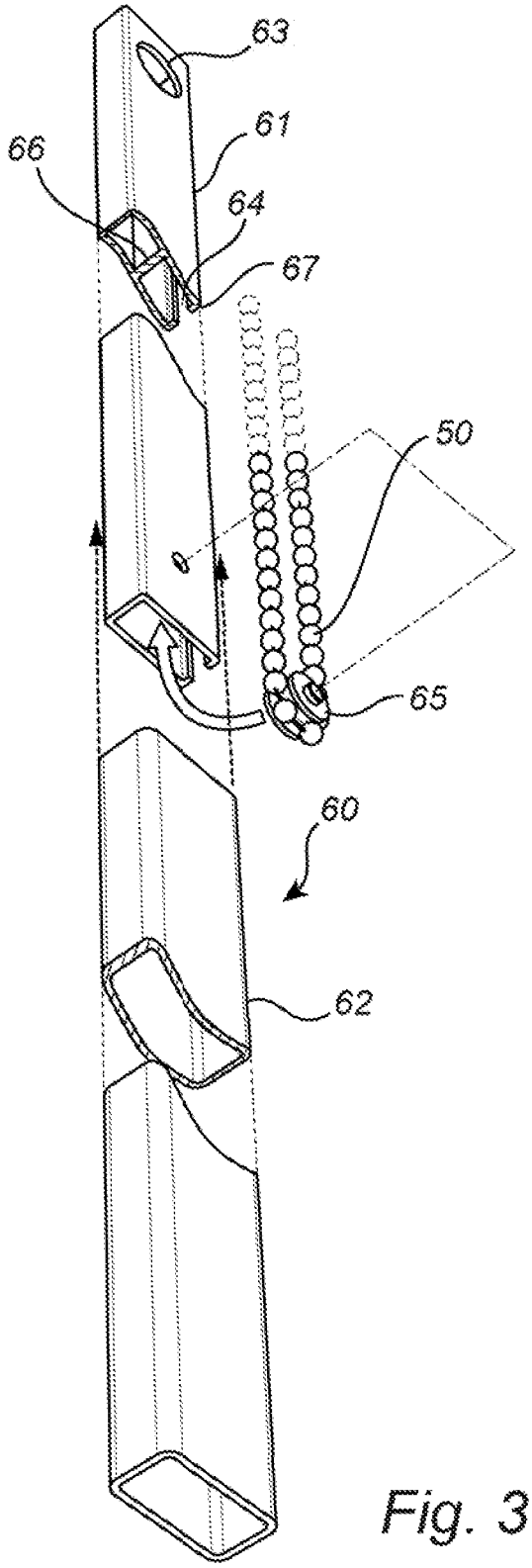
FIG. 3 discloses an exploded view of the pull cord arrangement.

Now turning to FIG. 3, the pull cord actuator 60, which may be the same as the pull cord actuator 3, will be described. The pull cord actuator 60 is formed as a telescopic rod comprising a first rod 61 and a second rod 62. The first rod 61 is adapted to encase the connecting element 28 and is pivotably arranged about the rotational axis and hence the longitudinal centre axis L of the winding element 4. The first rod 61 comprises in its upper end a through hole 63 adapted to encase the connecting element 28.

The first rod 61 comprises is the disclosed embodiment a rectangular cross section. It goes without saying that other cross sections are possible. It is however preferred that a non-rotation symmetrical cross section is used.

The first rod 61 comprises, in a wall portion 67 extending in parallel with the longitudinal center axis L of the winding element, a longitudinal slit 64. The slit 64 is adapted to engage the projection 39 of the carrier 37.

The first rod 61 comprises in its lower end a pulley 65 engaging the pull cord 50. The pull cord 50 is accordingly adapted to be received inside the first rod 61 and extend between the pulley 65 and the connecting element 28.

The first rod 61 comprises along its interior longitudinal extension a partition wall 66. When the pull cord 50 is arranged inside the first rod 61, the carrier 37 is adapted to be guided along the interior of the first rod 61 between the partition wall 66 and the opposed slit wall portion 67.

The second rod 62 encloses the first rod 61 and is guided by the same in a telescopic manner. Accordingly, the second rod 62 preferably has a cross sectional profile corresponding to the first rod 61 with the exception of the slit 64.

Now turning to FIG. 4*a* the assembled arrangement is disclosed. For better understanding, a part of the first and second rods 61, 62 is removed.

The closed loop of the pull cord 50 engages the connecting element 28. Further, the upper end of the first rod 61 is closed by a plug 68. The plug 68 is also illustrated in the exploded view of FIG. 2.

The upper end of the second rod 62 engages the carrier 37 via locking elements 69, such as screws extending through the second rod 62 and into the projection 39 of the carrier 37, which projection 39 extends through the slit 64.

Figure 4B:
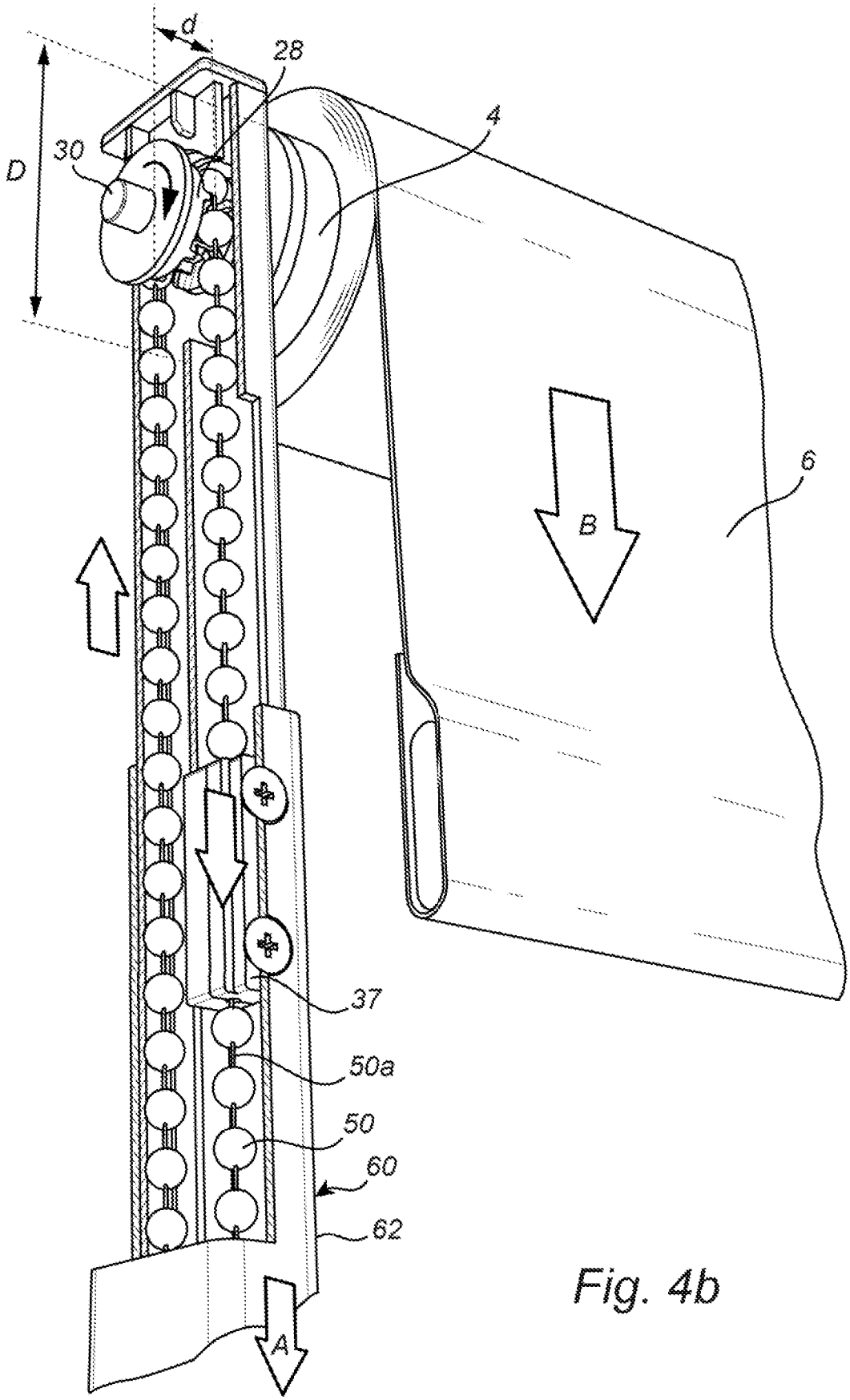
FIG. 4*b* discloses the operation of the pull cord arrangement when operating the pull cord actuator to release the blind.
Figure 5A:
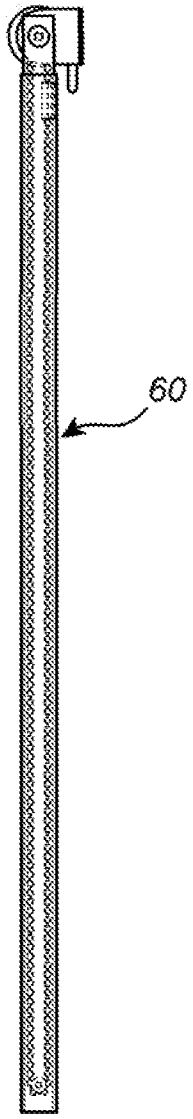
FIGS. 5*a* and 5*b* schematically disclose the pull cord arrangement when releasing the blind.
Figure 5B:
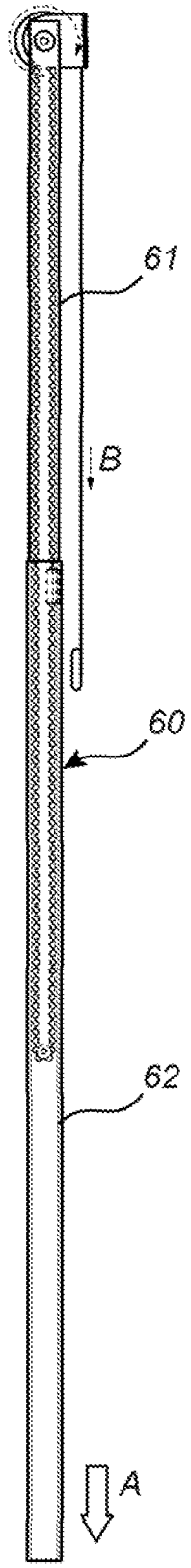

Now turning to FIGS. 4*b* and 5*a*-5*b*, the operation of the pull cord arrangement is illustrated. As the pull cord actuator 60 is operated by pulling the second rod 62, see arrow A, the engagement between the second rod 62 and the carrier 37 pulls the leading part 50*a* of the pull cord 50. By the non-rotational engagement between the connecting element 28 and the winding element 4, and the rotational engagement between the shaft 30 and the holder 2 (not disclosed in FIG. 4*b*), the pulling of the pull cord 50 will be transformed into a rotation of the winding element 4. The rotation of the winding element 4 will result in a release of the blind 6, see arrow B.

If the second rod 62 instead is pushed along the first rod 61, i.e. in the direction opposite arrow A, the rotational direction of the winding element 4 will be reversed and hence the blind 6 will be wound, i.e. moved in a direction opposite arrow B.

Due to the difference in the engagement diameter d of the connecting element 28 and the outer diameter D of the winding element 4, a gear change will result. By way of example, in case of a ratio 1:2, a longitudinal mutual displacement between the first and second rods 61, 62 of the pull cord actuator 60 will result in the double winding/releasing length of the blind 6. Also, as a result of the gear change, the length of the pull cord 50 may be reduced to the same extent and hence also the length of the pull cord actuator 60.

The pull cord 50 is encased by the pull cord actuator 60 whereby there is no risk that it is considered as a plaything or something that can cause choking or strangulation.

It is appreciated that the embodiments of the invention as disclosed above may be altered in different ways within the scope of the appended claims.

By way of example, it is to be understood that the pull cord arrangement can be arranged on either end of the roller blind 1.

In the disclosed embodiment the pull cord 50 is formed by a bead chain. It may also, with remained function be formed as toothed belt, a perforated belt of a chain. The skilled person will understand that the design of the radial projections 15, 26 of the first and second connectors 9, 19 must be adapted to the type of pull cord.

The connecting element 28 can be arranged in a number of ways. In its most simple form it may be arranged integral with the winding element. Also, it may be formed by the neck portions 13, 24 of one of the first and second connectors 9, 19 only.

The winding element 4 may have other cross sections than circular with remained function.

The upper end of the second rod 62 has been described as engaging the carrier 37 via locking elements 69, such as screws extending through the second rod 62 and into the projection 39 of the carrier 37. It is to be understood that the screws with remained function may be replaced by rivets, such as plastic rivets or by snap-fit means.

The invention claimed is:

1. A pull cord arrangement for a roller blind or a Venetian blind, comprising:

a winding element arranged to be connected to a blind such that the blind is released or wound in response to a rotational movement of the winding element about a rotational axis;

a connecting element coupled to the winding element to rotate together with the winding element;

and a pull cord engaging the connecting element so as to control the rotation of the connecting element and thus the winding element as the pull cord is operated; and wherein the ratio between the engagement diameter d of the connecting element at which diameter the pull cord operatively engages the connecting element and the outer diameter D of the winding element is smaller than 2:3, wherein the pull cord arrangement further comprises a pull cord actuator formed by a telescopic rod comprising a first rod, a second rod, and a carrier, the pull cord is received inside the first rod, wherein:

(i) the first rod comprises a first end, a second end, and a slit extending a length of the first rod, wherein the first rod first end extends from the connecting element;

(ii) the second rod comprising a first end, a second end, and a locking element, wherein the second rod is constructed to slide over the first rod and enclose the first rod second end; and (iii) the carrier is attached to the pull cord and to the locking element of the second rod, and extends through the slit of the first rod, the second rod being movable in relation to the first rod along a longitudinal extension of the first rod, whereby the pull cord is operated by moving the second rod along the longitudinal extension of the first rod, and whereby the pull cord is operated as the second rod is moved along the first rod.

2. The pull cord arrangement according to claim 1, wherein the pull cord forms a closed loop and is a bead chain, a toothed belt, a perforated belt or a chain, and wherein the connecting element along its outer circumference transverse the rotational axis comprises projections engaging the pull cord.

3. The pull cord arrangement according to claim 1, wherein the first rod is pivotably arranged about the rotational axis of the winding element.

4. The pull cord arrangement according to claim 3, wherein the first rod encases the connecting element.

5. The pull cord arrangement according to claim 1, wherein the winding element is a tube, an outer envelope surface thereof forming a support onto which the blind of a roller blind is to be wound or a support onto which the strings of the Venetian blind are to be wound.

6. The pull cord arrangement according to claim 1, wherein the winding element comprises a spring providing a rotational biasing of the winding element.

7. The pull cord arrangement according to claim 1, wherein the ratio between the engagement diameter d of the connecting element at which diameter the pull cord operatively engages the connecting element and the outer diameter D of the winding element is smaller than 1:2.

8. The pull cord arrangement according to claim 1, wherein the ratio between the engagement diameter d of the connecting element at which diameter the pull cord operatively engages the connecting element and the outer diameter D of the winding element is smaller than 1:3.

9. The pull cord arrangement according to claim 1, wherein the ratio between the engagement diameter d of the connecting element at which diameter the pull cord operatively engages the connecting element and the outer diameter D of the winding element is smaller than 1:4.

* * * * *